US007937784B2

(12) United States Patent
Qiu

(10) Patent No.: US 7,937,784 B2
(45) Date of Patent: May 10, 2011

(54) PARENT-CHILD SHOWERHEAD

(75) Inventor: Jia-Sen Qiu, Shenzhen (CN)

(73) Assignee: Globe Union Industrial Corp., Taichung County (TW)

( * ) Notice: Subject to any disclaimer, the term of this patent is extended or adjusted under 35 U.S.C. 154(b) by 590 days.

(21) Appl. No.: 12/125,595

(22) Filed: May 22, 2008

(65) Prior Publication Data

US 2009/0289129 A1 Nov. 26, 2009

(51) Int. Cl.
*A47K 17/00* (2006.01)
*A47K 3/28* (2006.01)

(52) U.S. Cl. ..... 4/661; 4/567; 4/601; 4/615

(58) Field of Classification Search ..... 4/596–605, 4/615–618, 567–570, 661; 239/282, 283, 239/443, 444, 446, 447
See application file for complete search history.

(56) References Cited

U.S. PATENT DOCUMENTS

| | | | | | |
|---|---|---|---|---|---|
| 2,867,230 | A * | 1/1959 | Bletcher et al. | 4/615 |
| 3,461,870 | A * | 8/1969 | Van Linge | 4/596 |
| 3,512,525 | A * | 5/1970 | Crowley, Jr. et al. | 4/559 |
| 3,722,800 | A * | 3/1973 | Shames et al. | 239/447 |
| 3,870,045 | A * | 3/1975 | Vaughan | 604/84 |
| 5,353,448 | A * | 10/1994 | Lee | 4/601 |
| 5,749,552 | A * | 5/1998 | Fan | 4/601 |
| 6,715,699 | B1 * | 4/2004 | Greenberg et al. | 239/447 |
| 7,043,776 | B1 * | 5/2006 | Wu | 4/601 |
| 7,360,723 | B2 * | 4/2008 | Lev | 239/447 |
| 7,665,676 | B2 * | 2/2010 | Lev | 239/447 |
| 7,740,186 | B2 * | 6/2010 | Macan et al. | 239/444 |
| 2005/0098661 | A1 | 5/2005 | Lev | |
| 2006/0131445 | A1 * | 6/2006 | Petrovic et al. | 239/443 |
| 2006/0138253 | A1 * | 6/2006 | Petrovic et al. | 239/447 |
| 2007/0158460 | A1 | 7/2007 | Lev | |
| 2008/0169362 | A1 * | 7/2008 | Kwan et al. | 239/442 |
| 2009/0276953 | A1 * | 11/2009 | Hsu et al. | 4/601 |

* cited by examiner

*Primary Examiner* — Khoa D Huynh
(74) *Attorney, Agent, or Firm* — Tim Tingkang Xia; Morris, Manning & Martin, LLP

(57) ABSTRACT

A parent-child showerhead includes a wall-mounted showerhead, a hand-held showerhead, and a showerhead bracket. The wall-mounted showerhead is fixed on a conduit extending from a wall and connects to the hand-held showerhead via a hose. The showerhead bracket is provided for the hand-held showerhead to hang thereon. The wall-mounted showerhead has a water diverter disposed therein for controlling the spray water from the wall-mounted showerhead or the hand-held showerhead or from both of them. The water diverter has an adjusting knob for changing a direction of the water flow, and the adjusting knob is located on the wall-mounted showerhead at side close to a user, which is convenient for users to operate. The showerhead bracket is disposed at a lower position of the wall-mounted showerhead, and has a receptacle. The receptacle is in a pivoted state to adjust an angle and provide the hand-held showerhead to be engaged therein.

13 Claims, 9 Drawing Sheets

PARENT-CHILD SHOWERHEAD

BACKGROUND OF THE INVENTION

1. Field of the Invention

The present invention relates to a parent-child showerhead, and in particularly to an integrated showerhead structure, which is easily installed and convenient in operation.

2. Related Art

Nowadays, a bathroom is generally equipped with a shower device. In order to cater different users' requirements, the current shower devices are substantially divided into two types: fixed (wall-mounted) showerhead and removable (hand-held) showerhead. Besides, some of the current shower devices are provided by equipping both of a fixed (wall-mounted) showerhead and a removable (hand-held) showerhead for users to select. Therefore, many techniques have been published in order to achieve the above objective, which are descried as following.

In US Patent Publication No. US2005/0098661A1, a conduit firstly connects to a fluid diverting element, and meanwhile the fluid diverting element connects to a fixed (wall-mounted) fluid dispensing unit and a hose simultaneously, and finally the hose connects to a removable (hand-held) fluid dispensing unit. The fixed fluid dispensing unit has a recess for the removable fluid dispensing unit to be engaged therein. The flows of the fluid to the fluid diverting element is via the conduit, and then diverted into two parts by the fluid diverting element: one of the flows out is through the fixed fluid dispensing unit; and the other flow out is from the removable fluid dispensing unit via the hose.

However, the fluid diverting element is disposed outside the fixed fluid dispensing unit and the structure thereof is complicated. Besides, during the period of installation, the fixed fluid dispensing unit must be removed first, and as a result, the above structure is not convenient in usage. Furthermore, the fluid diverting element is disposed behind the fixed fluid dispensing unit, which causes some inconveniences in operation. Additionally, the removable fluid dispensing unit is engaged in the recess of the fixed fluid dispensing unit, and the angle thereof cannot be adjusted.

In order to solve the above problems, some relevant techniques have also been published, which are described as following.

In US Patent Publication No. US2007/0158460A1, a conduit connects to a joint, and meanwhile the joint connects to a fixed showerhead and a hose simultaneously, and then the hose sequentially connects to a water diverter and a removable showerhead. The fixed showerhead has a recess for the removable showerhead to be engaged therein. The flow of the water sequentially through the conduit, the joint, the hose, the water diverter, and the removable showerhead, and by controlling the water diverter, the water spraying path for the removable showerhead is blocked, so that the water flows out are from the fixed showerhead.

Even the above structure is convenient to change the direction of the water flow through the water diverter, it still have some issues, such that when the parent and their children use the structure together, in order to prevent the child from playing with the removable showerhead under the curious motivation and naughty feature, the parent (adult) should pay attention to the child all the time when taking a bath, and thus avoiding the accidents caused by water spraying (when hot water is sprayed) or influencing the use of the fixed showerhead.

Therefore, it has become an urgent issue in this field to provide a showerhead having a simple structure, being conveniently operated, enabling the user to enjoy the fun of parent-child bathing and lowering the risks caused by improper operations.

SUMMARY OF THE INVENTION

Accordingly, the present invention is directed to a showerhead assembly structure integrally formed by a hand-held showerhead, a wall-mounted showerhead, and a showerhead bracket.

An object of the present invention lies in enabling the showerhead assembly to be assembled in a simpler way and to be operated more conveniently.

Another object of the present invention lies in enabling a parent to control the direction of water flow at a higher position and enabling a child to control the water-spraying state at a lower position, so as to enjoy the pleasure of parent-child bathing.

In order to achieve the above objects, the present invention provides a parent-child showerhead, which includes: a wall-mounted showerhead, a hand-held showerhead, and a showerhead bracket. The wall-mounted showerhead includes an outer housing, an inner housing, a front cover member, and a water diverter, in which the outer housing has an inlet cavity, the inner housing is screwed within the outer housing, the front cover member is screwed on a front end of the outer housing, and the water diverter is used to control a direction of water flow. The hand-held showerhead includes a handle member, a switching member, a front cover member, a small front cover, and a propeller blade, in which the switching member is screwed on a front end of the handle member, the small front cover is screwed on the switching member, so as to sandwich the front cover member between the small front cover and the switching member, and the propeller blade is disposed between the small front cover and the front cover member. The showerhead bracket is connected to the outer housing of the wall-mounted showerhead, and includes a connecting pipe, an external pipe, a receptacle, and a hose, in which one end of the connecting pipe is connected to the wall-mounted showerhead, the external pipe is sleeved on the connecting pipe, the receptacle is pivoted to the external pipe to adjust an angle, and the receptacle is provided for the hand-held showerhead to be engaged therein; and two ends of the hose are respectively connected to the other end of the connecting pipe of the showerhead bracket and a back end of the handle member of the hand-held showerhead.

The water diverter includes a body, a cover plate, and a sliding latch. The body has a water outlet at each end thereof, and the water outlets respectively connect to the front cover member and a connecting position between adjacent to the outer housing and the showerhead bracket. The cover plate is disposed above the body, and has a water inlet disposed at the top thereof for connecting the inlet cavity, and has three adjustment recesses at the bottom thereof. The sliding latch is disposed within the body and has a water baffle provided at each end thereof and penetrating into the water outlets of the body. The sliding latch has an adjusting knob disposed at a bottom thereof and located on the wall-mounted showerhead at side close to the user, which is conveniently operated and controlled by the user. The sliding latch has a bump on a top thereof. Through turning the adjusting knob, the bump may be selectively inserted into one of the adjustment recesses.

Furthermore, the switching member includes a fixed base, a rotary shaft, and three water-stop blocks. The rotary shaft is disposed facing the front cover member and located at a center of the fixed base. The rotary shaft is rotatable locked by a screw, such that the front cover member and the small front cover are both fixed on the rotary shaft. The fixed base is fixed on a front end of the handle member through three screws.

The front cover member has an inlet hole for water line mode and an inlet hole for massage mode at positions opposing to the position of the fixed base, and the inlet hole for massage mode is disposed slantwise. An annular portion, located at the other part of the front cover member except the central recess, has a plurality of water outlet holes for spraying water when the water-spraying state is switched to the water line mode.

When the water-spraying state is switched to the massage mode, the water flow flows through the inlet hole for massage mode disposed slantwise to drive the propeller blade to rotate, so as to intermittently stop the water flow from flowing towards the water outlet holes of the small front cover, thus intermittently spraying the water.

A common wall-mounted showerhead can be used alone, and if a hand-held showerhead needs to be used together, the showerhead bracket is installed on the wall-mounted showerhead, and then the hose and the hand-held showerhead are connected to the wall-mounted showerhead, so as to form the parent-child showerhead of the present invention. Such an integrated design can realize a simple structure that can be easily assembled and disassembled, which is conveniently operated by the user.

Preferably, the front cover member has a knob switch disposed at a predetermined position on a periphery thereof, so as to switch the water-spraying state among a water line mode, a massage mode, or a mode of both the water line mode and the massage mode simultaneously.

Preferably, the hand-held showerhead further has a decorative cover sandwiched between the handle member and the fixed base.

Preferably, an O-ring with a V-shaped cross section is further disposed between the fixed base and the front cover member, so as to prevent the water flow from leaking out.

With the structure of the present invention, the wall-mounted showerhead controls the water to flow towards the wall-mounted showerhead or the hand-held showerhead, or to flow towards both the wall-mounted showerhead and the hand-held showerhead, so as to achieve an efficacy of parent-child bathing. The water-spraying state of the hand-held showerhead is adjusted through the knob switch, for example, the water line mode, the massage mode, or a mode of both the water line mode and the massage mode simultaneously. The showerhead bracket is directly disposed on the wall-mounted showerhead and has a simple structure. Since the angle of the showerhead bracket is adjustable, when the hand-held showerhead is engaged into the showerhead bracket and the wall-mounted showerhead and the hand-held showerhead both spray water, the water spraying range thereof can be adjusted through the adjustable angle. The present invention not only has a simple structure, but also is conveniently operated.

BRIEF DESCRIPTION OF THE DRAWINGS

The present invention will become more fully understood from the detailed description given herein below for illustration only, and thus is not limitative of the present invention, and wherein.

DETAILED DESCRIPTION OF THE INVENTION

Hereinafter, preferred embodiments of the present invention are illustrated with reference to the drawings.

Figure 1:
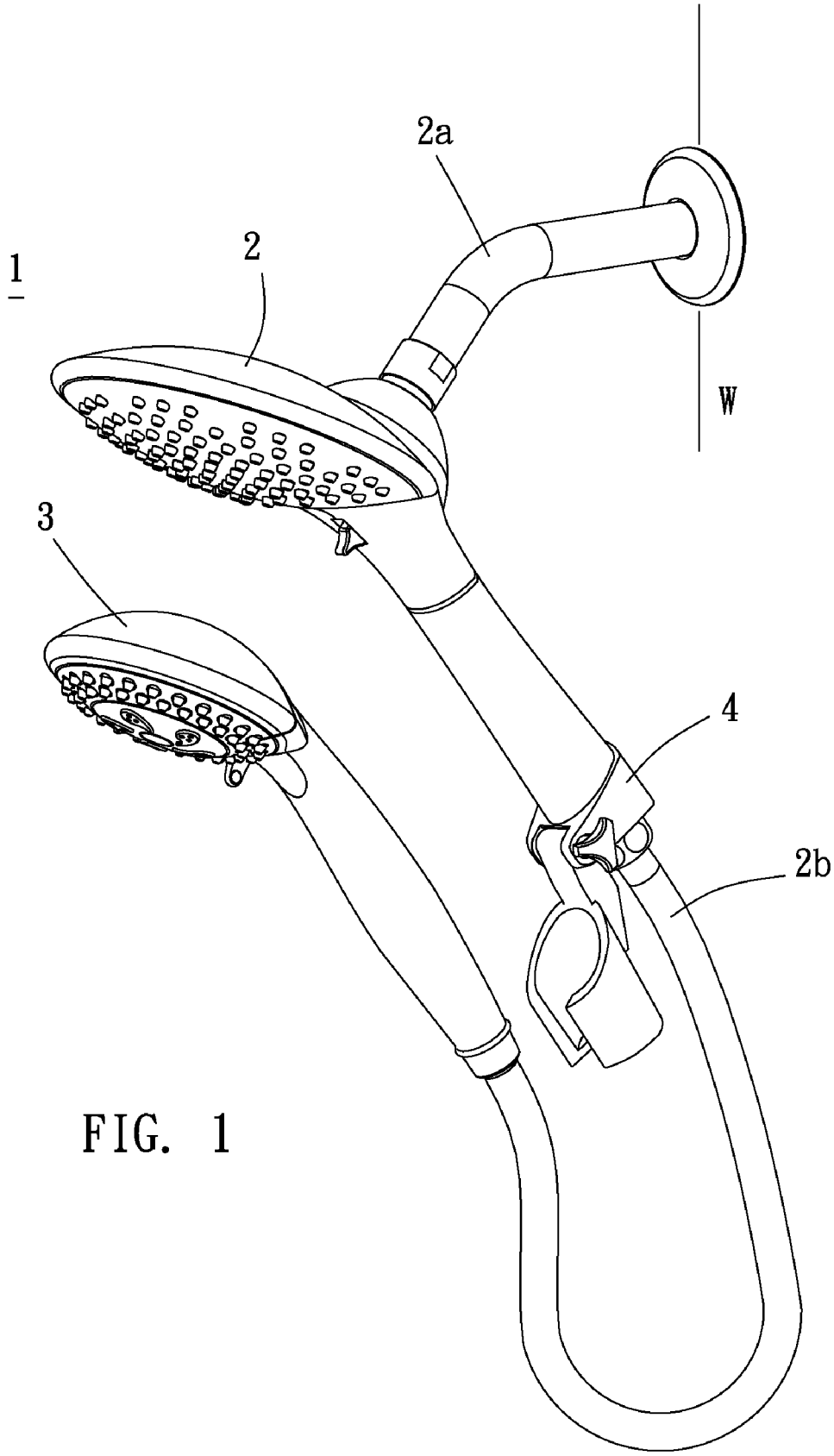
FIG. 1 is a structural view of an external appearance of a parent-child showerhead according to the present invention.

FIG. 1 is a structural view of an external appearance of a parent-child showerhead according to the present invention. Referring to FIG. 1, a parent-child showerhead 1 of the present invention includes a wall-mounted showerhead 2, a hand-held showerhead 3, and a showerhead bracket 4. The wall-mounted showerhead 2 is fixed on a wall W via a conduit 2*a*, and connects to the hand-held showerhead 3 via a hose 2*b* through using the showerhead bracket 4. One end of the showerhead bracket 4 connects to the wall-mounted showerhead 2, and the other end connects to the hose 2*b* to hand on the hand-held showerhead 3.

Generally, the wall-mounted showerhead 2 can be used alone, and if the hand-held showerhead 3 needs to be used together, the showerhead bracket 4 is installed on the wall-mounted showerhead 2, and then the hose 2*b* and the hand-held showerhead 3 are both connected to the wall-mounted showerhead 2, so as to form the parent-child showerhead 1 of the present invention. Such an integrated design can realize a simple structure that is easily assembled and disassembled, which is conveniently operated by the user, and the operating principle and operations thereof are described below in detail.

Figure 2A:
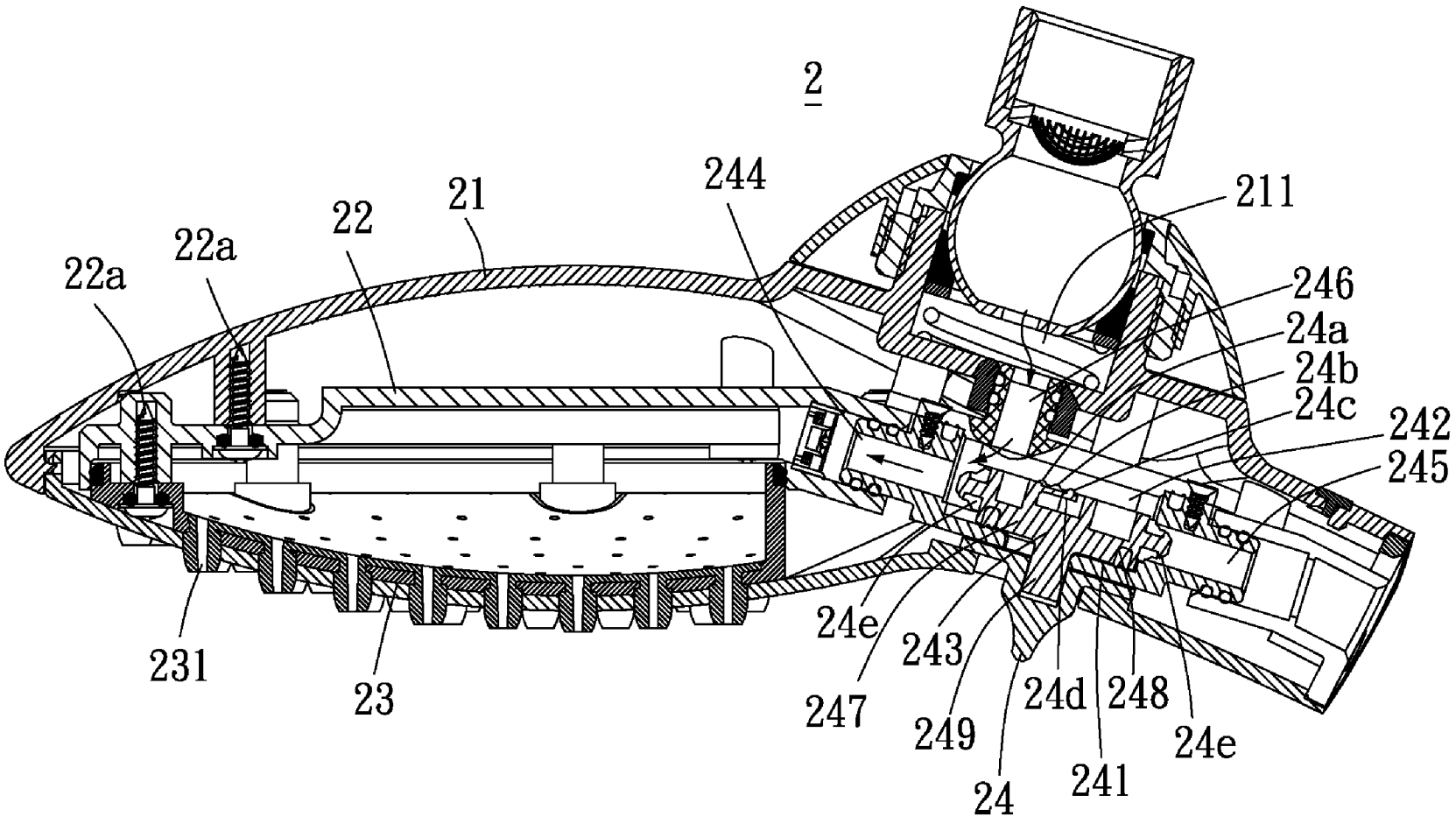
FIG. 2A is a first partial cross-sectional view of a wall-mounted showerhead in the parent-child showerhead according to the present invention.
Figure 2B:
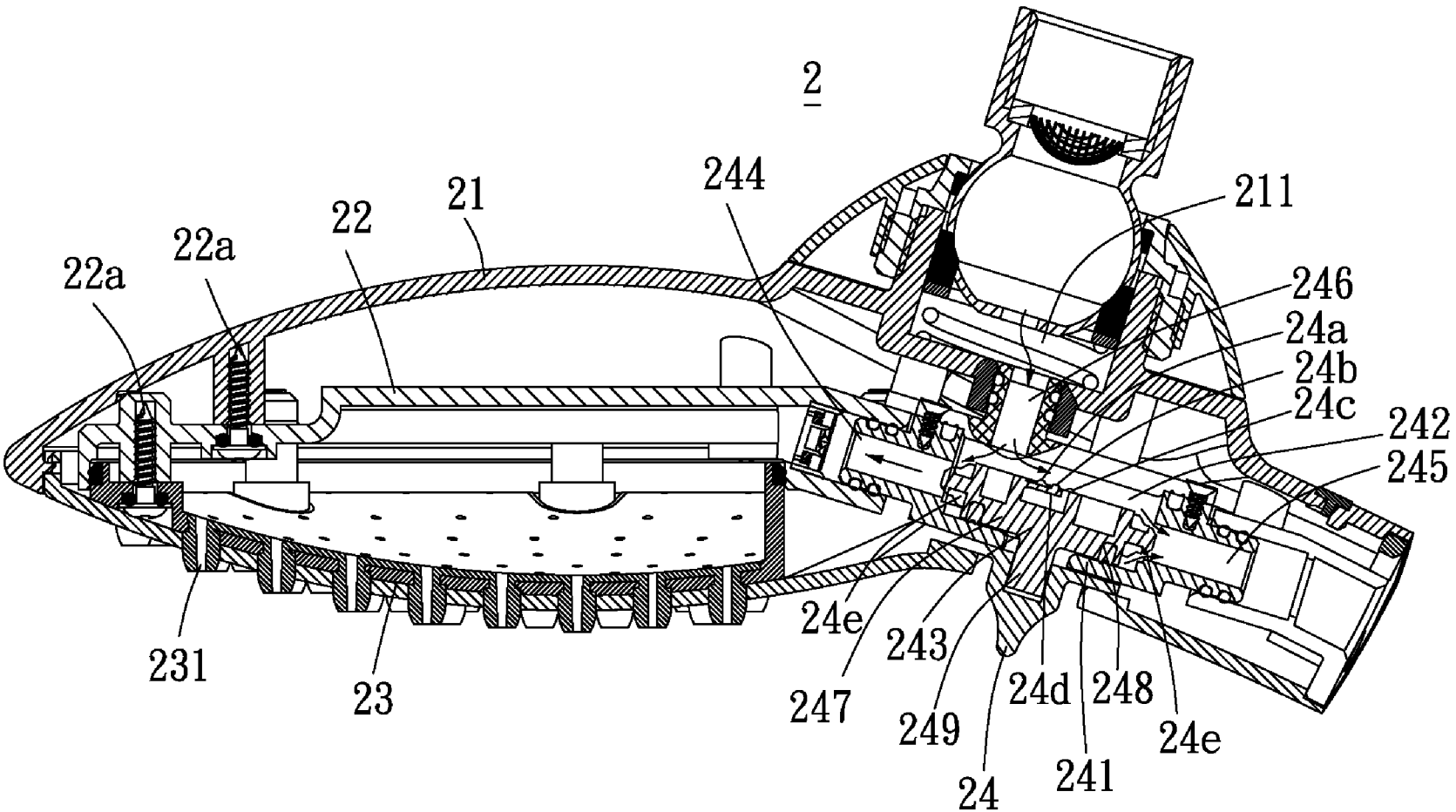
FIG. 2B is a second partial cross-sectional view of a wall-mounted showerhead in the parent-child showerhead according to the present invention.
Figure 2C:
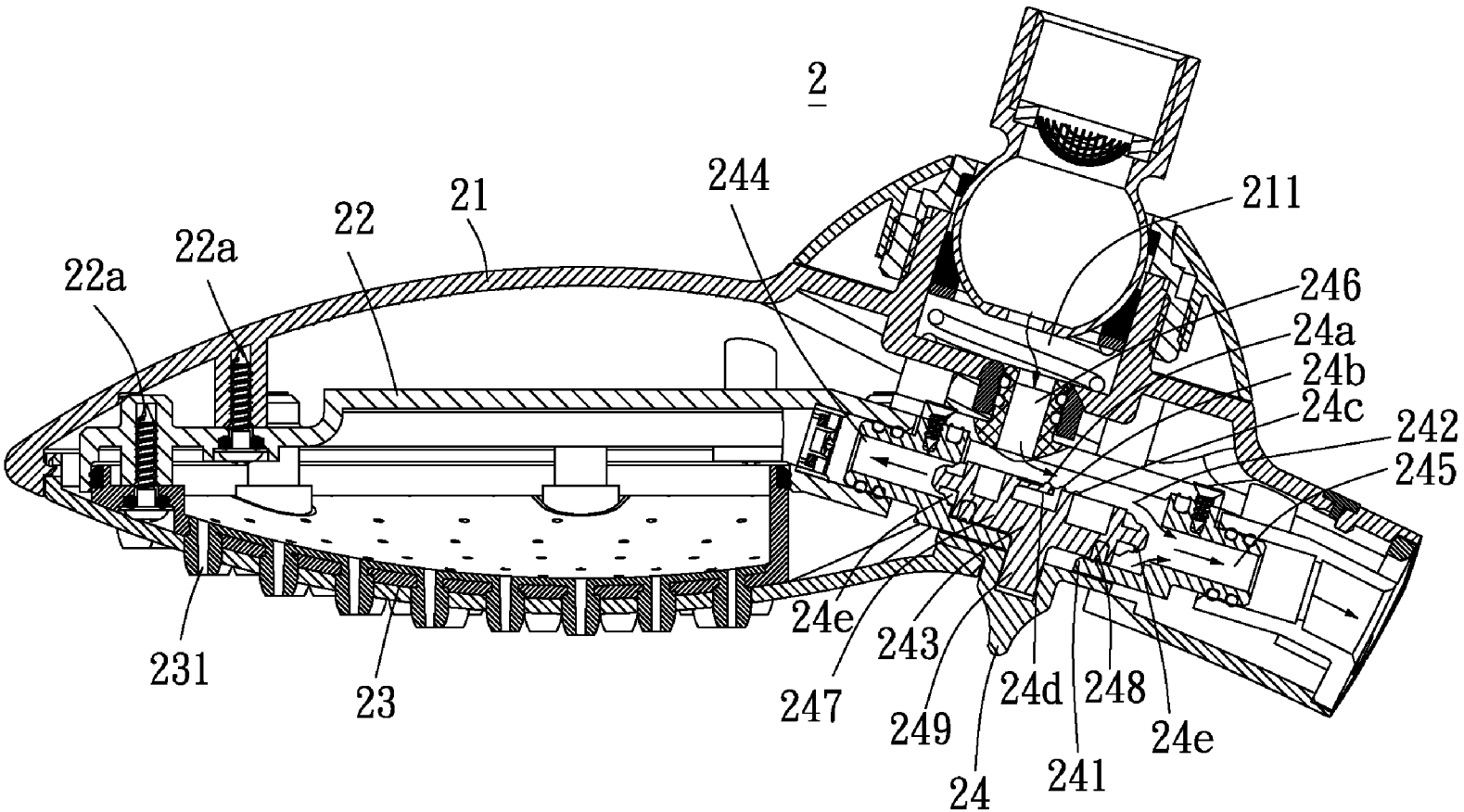
FIG. 2C is a third partial cross-sectional view of a wall-mounted showerhead in the parent-child showerhead according to the present invention.

FIGS. 2A, 2B, and 2C are partial cross-sectional views of a wall-mounted showerhead in the parent-child showerhead according to the present invention. Referring to FIGS. 2A, 2B, and 2C together, the wall-mounted showerhead 2 includes an outer housing 21, an inner housing 22, a front cover member 23, and a water diverter 24.

The outer housing 21 is connected to the conduit 2*a*, and the water flows in via the conduit 2*a*, and then collected in the inlet cavity 211. The inner housing 22 is fixed within the outer housing 21 through a screw 22*a*.

The front cover member 23 has a plurality of through holes 231 and is fixed on a front end of the inner housing 22 through the screw 22*a*.

The water diverter 24 is disposed between the outer housing 21 and the inner housing 22, and includes a body 241, a cover plate 242, and a sliding latch 243. The body has water outlets 244, 245 at two ends thereof respectively. The water outlets 244, 245 are respectively connected to the front cover member and adjacent to a connecting position between the outer housing 21 and the showerhead bracket 4. The cover plate 242, disposed above the body 241, has a water inlet 246 disposed at a top thereof and connected to the inlet cavity 211, so that the water flow collected in the inlet cavity 211 flows towards the water inlet 246. The cover plate 242 further has three adjustment recesses 24*a*, 24*b*, and 24*c* on a bottom thereof. The sliding latch 243, disposed within the body 241, and has water baffles 247, 248 disposed at two ends thereof and penetrating into the water outlets 244, 245. The sliding latch 243 has a washer 24*e* sleeved thereon, and has an adjusting knob 249 on the bottom thereof and a bump 24*d* on the top thereof. Through turning the adjusting knob, the bump 24*d* is selectively inserted into one of the adjustment recesses 24*a*, 24*b*, or 24*c*. The adjusting knob 249 is disposed on a surface close to the user, which is more convenient for the user to operate and control, compared with the technique and structure in the prior art.

Particularly, the water flow is firstly collected in the inlet cavity 211 and then enters the water diverter 24 via the water inlet 246. When the user turns the adjusting knob 249 to insert the bump 24*d* into the third adjustment recess 24*c* (referring to FIG. 2A), the water baffle 248 of the sliding latch 243 plugs the water outlet 245. As a result, the water merely flows to the water outlet 244 and flows out via the through hole 231 of the front cover member 23.

When the user turns the adjusting knob 249 to insert the bump 24*d* in the second adjustment recess 24*b* (referring to FIG. 2B), the two water baffles 247 and 248 of the sliding latch 243 do not plug the water outlets 244 and 245. As a result, the water flows to the water outlets 244 and 245 simultaneously and flows out via the through hole 231 of the front cover member 23 and directly flows to the hand-held showerhead 3 through the showerhead bracket 4 and the hose 2*b*.

Furthermore, when the user turns the adjusting knob 249 to insert the bump 24*d* in the first adjustment recess 24*a* (referring to FIG. 2C), the water baffle 247 of the sliding latch 243 plugs the water outlet 244. As a result, the water merely flows to the water outlet 245 and directly flows to the hand-held showerhead 3 through the showerhead bracket 4 and the hose 2*b*.

Figure 5:
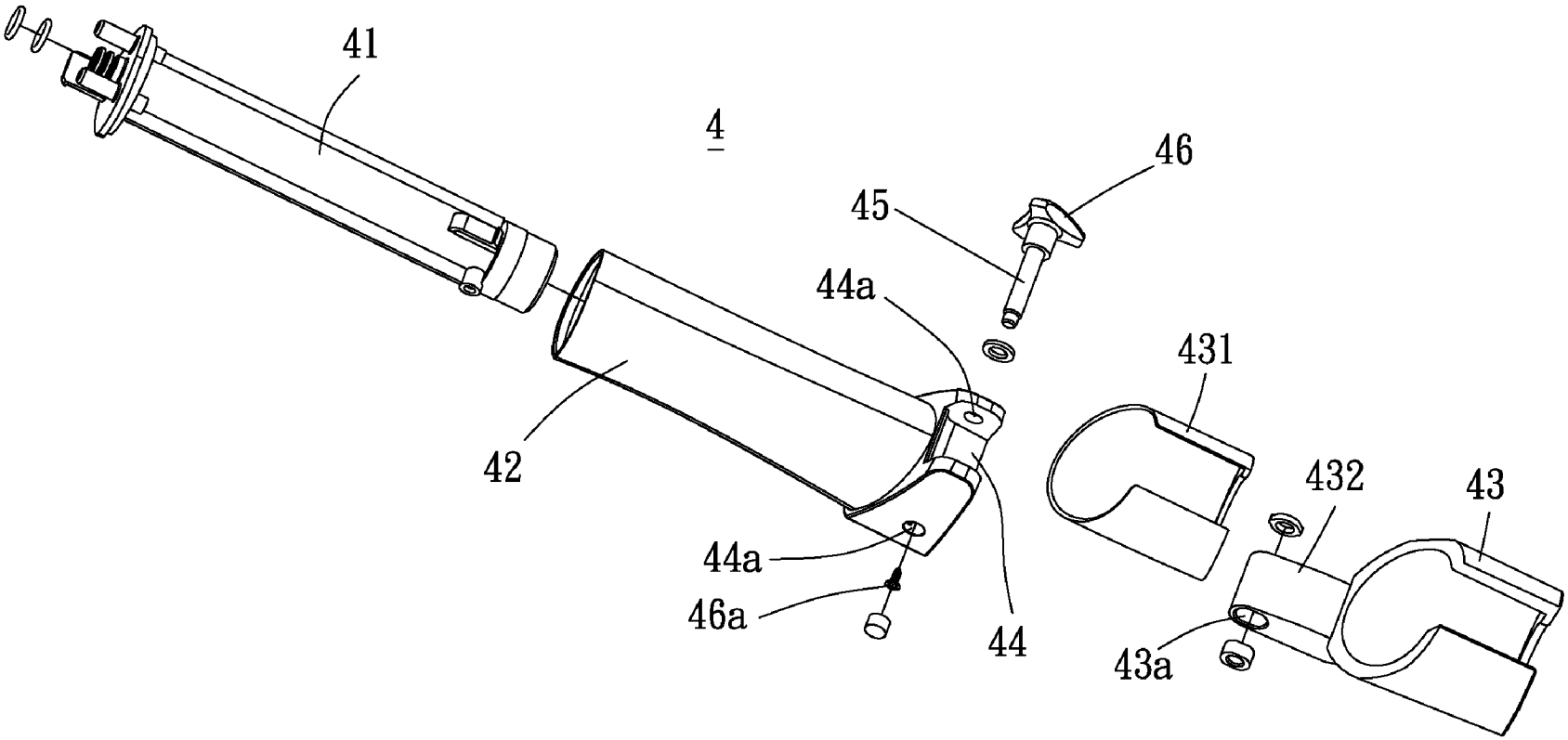
FIG. 5 is an exploded view of a showerhead bracket structure in the parent-child showerhead according to the present invention.

FIG. 5 is an exploded view of a showerhead bracket structure in the parent-child showerhead according to the present invention. Referring to FIG. 5, the showerhead bracket 4 includes a connecting pipe 41, an external pipe 42, and a receptacle 43. One end of the connecting pipe 41 is connected to the wall-mounted showerhead 2, and the other end connects to the hose 2*b*, which allows the water flow passing therethrough. The external pipe 42 is sleeved on the connecting pipe 41. One end of the external pipe 42 adjacent to the hose 2*b* is extended to form a U-shaped slot 44 along a direction perpendicular to a major axis direction of the external pipe 42. The U-shaped slot 44 respectively has a mounting hole 44*a* on each sidewall thereof. The receptacle 43 is provided for the hand-held showerhead 3 to be engaged therein. The receptacle 43 has a space washer 431 disposed therein, which enables the hand-held showerhead 3 to be stably and smoothly engaged therein. The receptacle 43 has a protrusion portion 432 extending at the top thereof. The protrusion portion 432 has a connecting hole 43*a* disposed opposing to the mounting hole 44*a*. The protrusion portion 432 can be inserted into the U-shaped slot 44, and meanwhile, a knob rod 45 penetrates through the mounting holes 44*a* and the connecting hole 43*a* simultaneously. Two ends of the knob rod 45 are fixed tightly by means of a knob 46 and a screw 46*a*.

Furthermore, when the knob 46 is screwed loosely, the receptacle 43 is rotated with the knob rod 45 as a pivot, so as to adjust an angle for the hand-held showerhead 3 to be engaged in the showerhead bracket 4. When the hand-held showerhead 3 is engaged into the showerhead bracket 4, and the wall-mounted showerhead 2 and the hand-held showerhead 3 both spray water, the water spraying range of the wall-mounted showerhead 2 and the hand-held showerhead 3 can be shrunk or enlarged by means of adjusting the angle of the showerhead bracket 4. Definitely, when the hand-held showerhead 3 is engaged in the showerhead bracket 4 and merely the hand-held showerhead 3 sprays water, the angle of the showerhead bracket 4 can also be adjusted to change the water spraying angle of the hand-held showerhead 3.

Figure 3A:
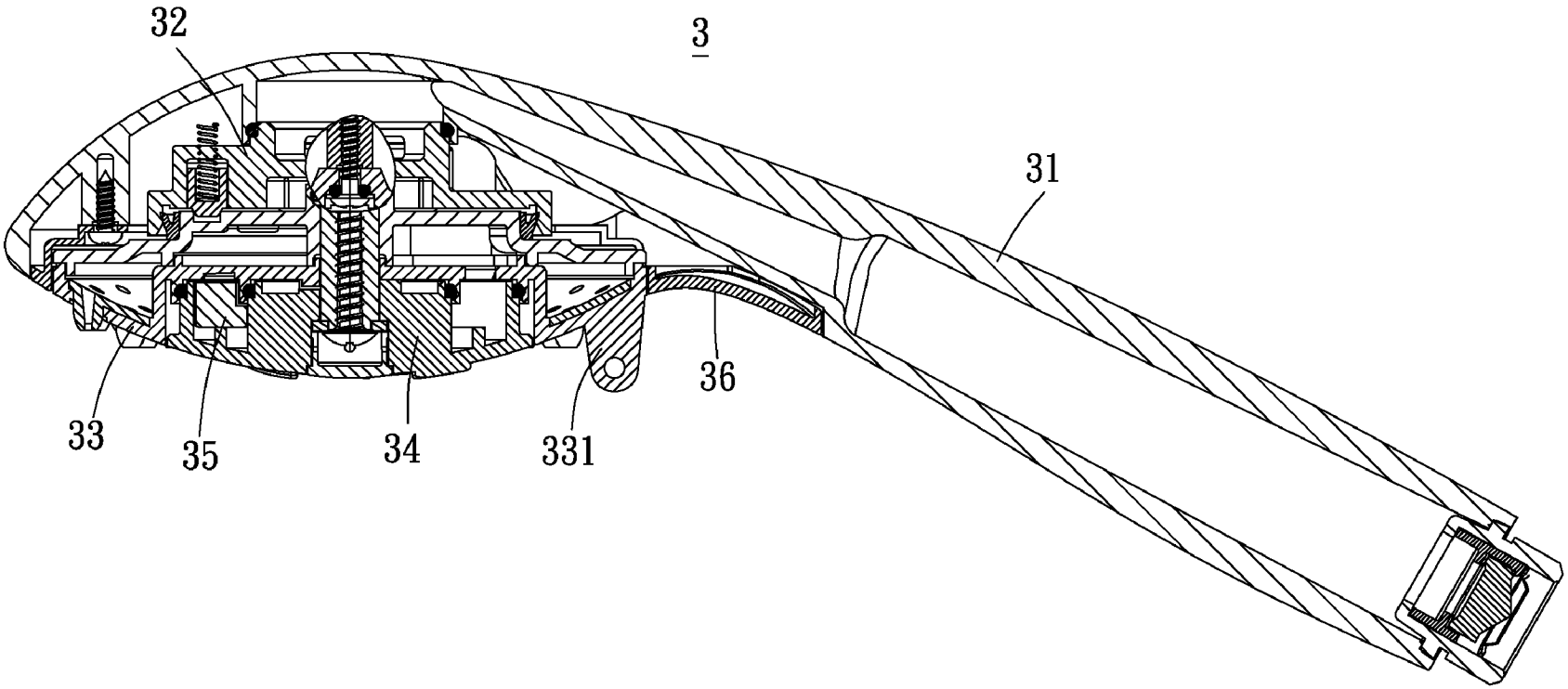
FIG. 3A is a cross-sectional view of a hand-held showerhead in the parent-child showerhead according to the present invention.
Figure 3B:
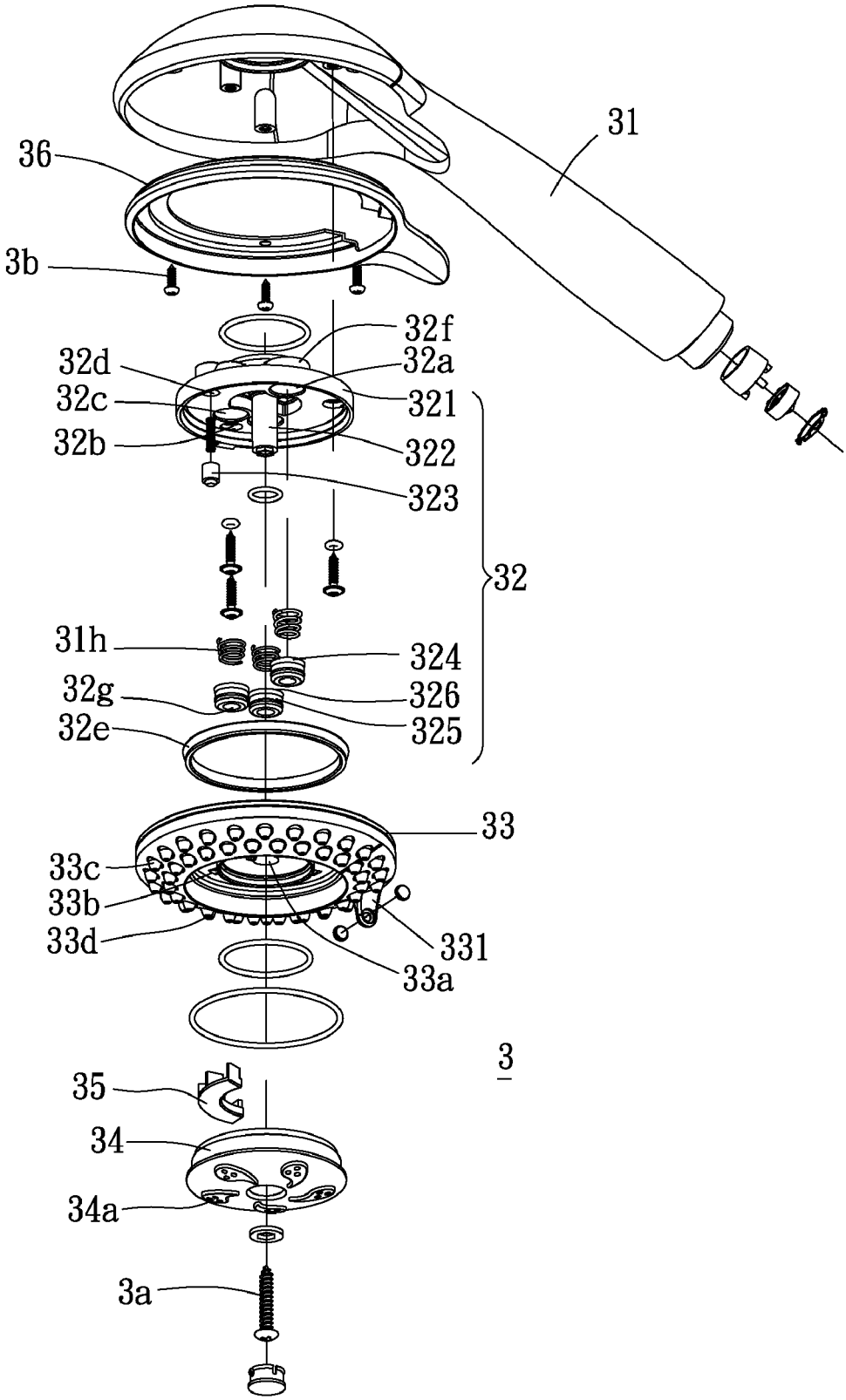
FIG. 3B is an exploded view of the hand-held showerhead in the parent-child showerhead according to the present invention.

FIGS. 3A and 3B are respectively a cross-sectional view and an exploded view of the hand-held showerhead in the parent-child showerhead according to the present invention. Referring to FIGS. 3A and 3B together, the hand-held showerhead 3 of the present invention includes a handle member 31, a switching member 32, a front cover member 33, a small front cover 34, and a propeller blade 35.

A back end of the handle member 31 is connected to the hose 2*b*, which enables the water flowing from the wall-mounted showerhead 2 via the hose 2*b* to flow therein. A front end of the handle member 31 is connected to a decorative cover 36. The switching member 32 is disposed between the decorative cover 36 and the front cover member 33. The small front cover 34 is installed at a central portion of the front cover member 33. The propeller blade 35 is disposed between the front cover member 33 and the small front cover 34.

The switching member 32 includes a fixed base 321, a rotary shaft 322, a locking pin 323, and three water-stop blocks 324, 325, and 326. The rotary shaft 322 is disposed at the center of the fixed base 321 and faces the front cover member 33, and a screw 3*a* is locked in the rotary shaft 322, so as to fix both the front cover member 33 and the small front cover 34 on the rotary shaft 322. The fixed base 321 is fixed on a front end of the handle member 31 through three screws 3*b*, so as to sandwich the decorative cover 36 there-between.

The fixed base 321 has three water inlet recesses 32*a*, 32*b*, and 32*c*. Each of the water inlet recesses 32*a*, 32*b* and 32*c* has a notch 32*f*. The water inlet recess 32*a* and the water inlet recesses 32*b*, 32*c* are disposed opposing to each other based on the rotary shaft 322 as a center point. That is, the water inlet recess 32*a* is disposed away from the water inlet recesses 32*b*, and 32*c*. The fixed base 321 further has a mode-switching recess 32*d*. The locking pin 323 is installed in the mode-switching recess 32*d* and has two ends being pressed against the fixed base 321 and the front cover member 33 respectively.

An O-ring 32*e* with a V-shaped cross section is further disposed between the fixed base 321 and the front cover member 33 to make the fixed base 321 and the front cover member 33 be tightly combined, thereby preventing the water from leaking out.

The three water-stop blocks 324, 325, and 326 are configured into a hollow structure and disposed in the water inlet recesses 32*a*, 32*b*, and 32*c* respectively. Each of the water-stop blocks 324, 325, and 326 has a through hole 32*g* for water to flow through. Each of the water-stop blocks 324, 325, and 326 further has a spring 32*h* installed therein, so as to force the switching member 32 and the front cover member 33 to be tightly combined, thereby preventing water from leaking out.

The front cover member 33 is configured into a structure having a central recessed portion, and has a through hole 33*a* at a center portion thereof for the rotary shaft 322 passing therethrough. The small front cover 34 is disposed at the central recessed portion of the front cover member 33. The front cover member 33 has a knob switch 331 disposed at a predetermined position of a periphery thereof, so as to switch the water-spraying state among a water line mode, a massage mode, or a mode of both the water line mode and the massage mode simultaneously. The front cover member 33 has an inlet hole of a water line mode 33*b* and an inlet hole of a massage mode 33*c* at positions opposing to the fixed base 321. The inlet hole of a massage mode 33*c* is disposed slantwise. The annular portion, located on the other part of the front cover member 33 except the central recess, has a plurality of water outlet holes 33*d* for spraying water when the water spraying state is switched to the water line mode.

Correspondingly, the small front cover 34 also has a plurality of water outlet holes 34*a* for spraying water when the water spraying state is switched to the massage mode.

When the water spraying state is switched to the massage mode, the water flow flows through the inlet hole of massage mode 33*c* disposed slantwise to drive the propeller blade 35 to rotate. Since the rotation of the propeller blade 35 intermittently stops the water from flowing to the water outlet holes 34*a* of the small front cover 34, an intermittent water spraying state is produced, thereby achieving a massage effect.

Figure 4B:
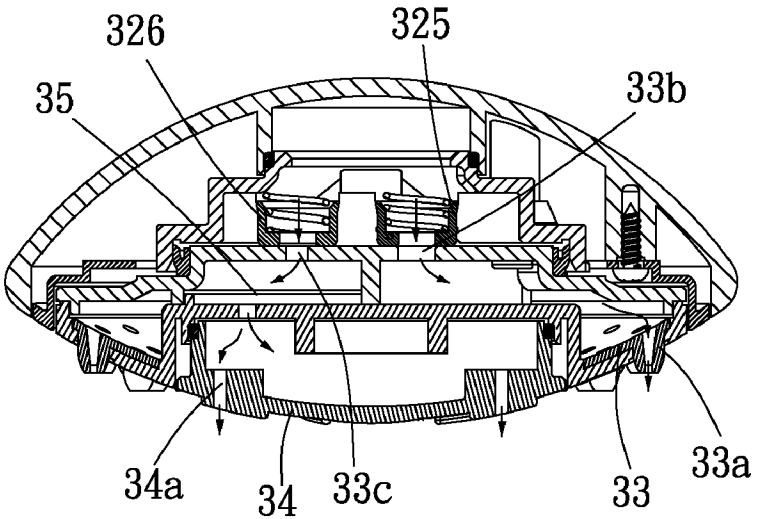
FIG. 4B is a second principle diagram of the hand-held showerhead in the parent-child showerhead according to the present invention, when switching among different water-spraying modes.
Figure 4A:
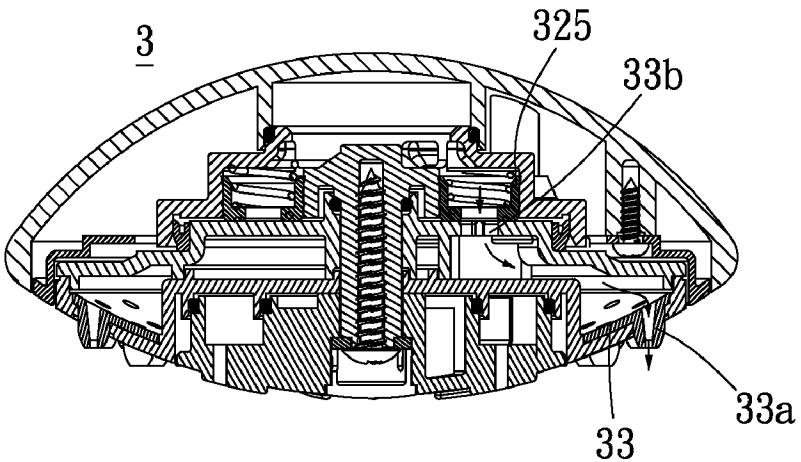
FIG. 4A is a first principle diagram of the hand-held showerhead in the parent-child showerhead according to the present invention, when switching among different water-spraying modes.
Figure 4C:
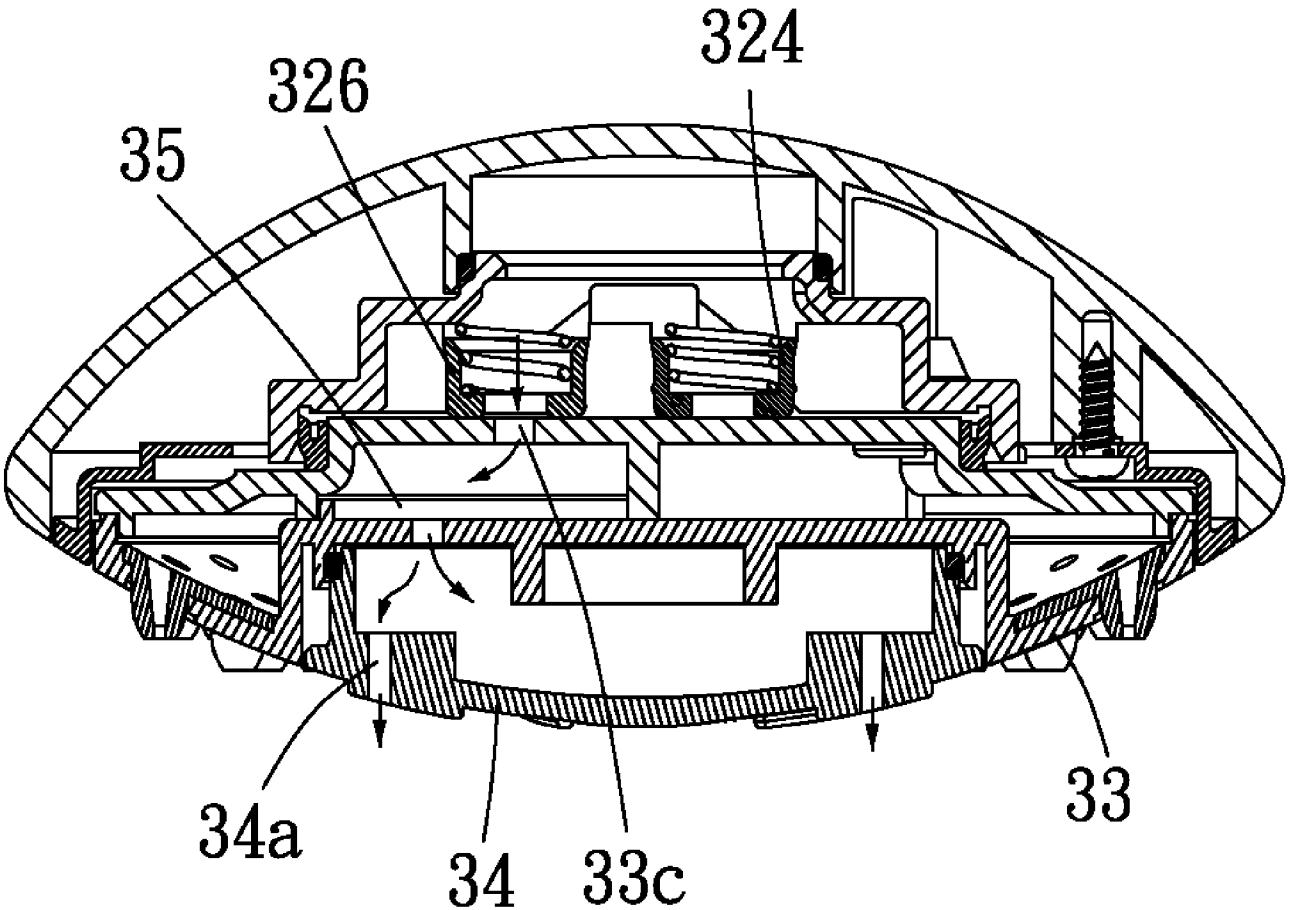
FIG. 4C is a third principle diagram of the hand-held showerhead in the parent-child showerhead according to the present invention, when switching among different water-spraying modes.

FIGS. 4A, 4B, and 4C are principle diagrams of the hand-held showerhead in the parent-child showerhead according to the present invention, when switching among different water-spraying modes. Referring to FIGS. 4A, 4B, and 4C together, when the water-stop block 325 is switched to be overlapped with the inlet hole 33*b* for water line mode by turning the knob switch 331 of the hand-held showerhead 3 (shown in FIG. 4A), the water flows out via the through hole 33*a* of the front cover member 33 to realize the water line mode. If the knob switch 331 is turned for about 50 degrees and the water-stop blocks 325, 326 are respectively overlapped with the inlet hole of water line mode 33*b* and the inlet hole of massage mode 33*c* (shown in FIG. 4B), the water flows out via the through hole 33*a* of the front cover member 33, and meanwhile the water flows through the inlet hole of massage mode 33*c* disposed slantwise, so as to drive the propeller blade 35 to rotate, thereby intermittently stopping the water from flowing to the water outlet holes 34*a* of the small front cover 34, thus forming an intermittent water spraying state and reaching the massage mode. If the knob switch 331 is turned by about 100 degrees and the water-stop block 326 is overlapped with the inlet hole of massage mode 33*c* (shown in FIG. 4C), the water flows through the inlet hole of massage mode 33*c* disposed slantwise to drive the propeller blade 35 to rotate, so as to intermittently stop the water from flowing to the water outlet holes 34*a* of the small front cover 34, thus forming an intermittent water spraying state and reaching the massage mode.

Therefore, with the above structure, the parent-child showerhead of the present invention utilizes the wall-mounted showerhead to control the water flow to flow to the wall-mounted showerhead, or the hand-held showerhead, or to both the wall-mounted showerhead and the hand-held showerhead, which can be easily operated and achieve the effect of parent-child bathing. The water spraying state is adjusted through using the knob switch of the hand-held showerhead, such as the water line mode, the massage mode, or the mode of both the water line mode and the massage mode simultaneously. The showerhead bracket is directly disposed on the wall-mounted showerhead and has a simple structure. Since the angle of the showerhead bracket can also be adjusted, when the hand-held showerhead is engaged into the showerhead bracket and both the wall-mounted showerhead and the hand-held showerhead spray water simultaneously, the water supply range thereof can be adjusted through the showerhead bracket.

Furthermore, the water diverter is disposed on the wall-mounted showerhead at a higher position, so that a parent (adult) can control the direction of water spray flowing to the wall-mounted showerhead, or the hand-held showerhead, or to both the wall-mounted showerhead and the hand-held showerhead simultaneously. Besides, the knob switch is disposed on the hand-held showerhead at a lower position, so that the a child (kid) can control the water spraying state among the water line mode, the massage mode, or the mode of both the water line mode and the massage mode simultaneously, to enjoy the pleasure of parent-child bathing. Especially when the hot water is sprayed, the child can be prevented from being hurt by hot water due to controlling the water spraying direction at will.

What is claimed is:

1. A parent-child showerhead, comprising a wall-mounted showerhead being fixed on a conduit extending from a wall, a hand-held showerhead connecting to the wall-mounted showerhead via a hose, and a showerhead bracket for the hand-held showerhead to hang thereon, wherein the wall-mounted showerhead has a water diverter disposed therein for controlling a spray water from the wall-mounted showerhead or the hand-held showerhead or from both the wall-mounted showerhead and the hand-held showerhead, the water diverter having an adjusting knob for changing direction of water flow, the adjusting knob being located on the wall-mounted showerhead at side close to a user so as to facilitate operations of the user, wherein the wall-mounted showerhead further comprises an outer housing, an inner housing, and a front cover member, the outer housing having an inlet cavity, the inner housing being screwed within the outer housing, and the front cover member being screwed on a front end of the outer housing;

wherein the hand-held showerhead further comprises a handle member, a switching member, a front cover member, a small front cover, and a propeller blade, the switching member being screwed on a front end of the handle member, the small front cover being screwed on the switching member, so as to sandwich the front cover member between the small front cover and the switching member, and the propeller blade being disposed between the small front cover and the front cover member;

the showerhead bracket is disposed at a lower position of the wall-mounted showerhead and has a receptacle, the receptacle being in a pivoted state to adjust an angle and providing the hand-held showerhead to be engaged therein, wherein the showerhead bracket further has a connecting pipe and an external pipe, one end of the connecting pipe connecting to a lower position of the wall-mounted showerhead, the external pipe being sleeved on the connecting pipe, and the receptacle being pivoted to the external pipe to adjust the angle;

wherein the water diverter further comprises a body, a cover plate, and a sliding latch, the body having a water outlet at each end thereof respectively, the water outlets being respectively connected to the front cover member and a connecting position between the adjacent outer housing and the showerhead bracket; the cover plate being disposed above the body and has a water inlet disposed at a top thereof for connecting to the inlet cavity and three adjustment recesses at a bottom thereof; the sliding latch being disposed within the body and having a water baffle at each end thereof and penetrating into each water outlet of the body respectively, the adjusting knob being disposed at a bottom of the sliding latch, and the sliding latch having a bump at a top thereof, and by turning the adjusting knob, the bump being selectively inserted into one of the adjustment recesses to change the direction of water flow, wherein each water baffle has a washer sleeved thereon; and wherein the switching member further comprises a fixed base, a rotary shaft, a locking pin and three water-stop blocks, the rotary shaft being disposed at a center of the fixed base facing the front cover member, the rotary shaft being rotatably locked by a screw, such that both of the front cover member and the small front cover being fixed to the rotary shaft, and the fixed base being fixed on a front end of the handle member through three screws, the fixed base also has a mode-switching recess, the locking pin is installed in the mode-switching recess and has two ends being pressed against the fixed base and the front cover member, respectively.

2. The parent-child showerhead according to claim 1, wherein the hand-held showerhead further has a decorative cover provided between the handle member and the fixed base.

3. The parent-child showerhead according to claim 1, wherein the fixed base has at least two water inlet recesses disposed thereon, and each water inlet recess has a notch.

4. The parent-child showerhead according to claim 3, wherein the water-stop blocks are configured into a hollow structure and are disposed in the water inlet recesses respectively, and each water-stop block has a through hole for the water passing therethrough.

5. The parent-child showerhead according to claim 4, further comprising a spring disposed in each water-stop block so as to connect the switching member and the front cover member tightly to avoid water leaking out.

6. The parent-child showerhead according to claim 1, further comprising an O-ring with V-shaped cross section disposed between the fixed base and the front cover member.

7. The parent-child showerhead according to claim 1, wherein the front cover member is configured into a structure having a central recessed portion, a through hole being provided at a center portion thereof for the rotary shaft passing therethrough, the small front cover being disposed at the central recessed portion of the front cover member, and a plurality of water outlet holes being disposed at an annular portion located at an other part of the front cover member except the central recess.

8. The parent-child showerhead according to claim 7, wherein the front cover member has a knob switch disposed at a predetermined position on a periphery thereof, so as to switch a water-spraying state among a water line mode, a massage mode, or a mode of both the water line mode and the massage mode simultaneously.

9. The parent-child showerhead according to claim 8, wherein the front cover member has an inlet hole of water line mode and an inlet hole of massage mode at positions opposing to the fixed base, the inlet hole for massage mode being disposed slantwise, and the annular portion located at an other part of the front cover member except the central recess having the plurality of water outlet holes for spraying water when the water-spraying state being switched to the water line mode.

10. The parent-child showerhead according to claim 1, wherein the small front cover has a plurality of water outlet holes, for spraying water when the water-spraying state is switched to the massage mode.

11. The parent-child showerhead according to claim 1, wherein one end of the external pipe adjacent to the hose is extended to form a U-shaped slot along a direction perpendicular to a major axis direction of the external pipe, and the U-shaped slot respectively has a mounting hole on each sidewall thereof.

12. The parent-child showerhead according to claim 11, wherein the receptacle has a space washer disposed therein, and has a protrusion portion extending at a top thereof, the protrusion portion has a connecting hole penetrating therethrough and the protrusion portion can insert to the U-shaped slot, and a knob rod penetrates through both the mounting holes and the connecting hole simultaneously.

13. The parent-child showerhead according to claim 12, wherein two ends of the knob rod are respectively disposed with a knob and a screw, so as to firmly screw the external pipe with the receptacle or to loosen the external pipe from the receptacle to adjust an angle.

* * * * *